US010427170B2

(12) United States Patent
Lüersmann et al.

(10) Patent No.: US 10,427,170 B2
(45) Date of Patent: Oct. 1, 2019

(54) ROTOR OF A CENTRIFUGAL SEPARATOR WITH AXIALLY ASSEMBLED ELEMENTS CLAMPED BY A SPRING

(71) Applicant: HENGST SE, Muenster (DE)

(72) Inventors: Markus Lüersmann, Telgte (DE); Mustafa Kuzgunoglu-Hennecke, Muenster (DE); Sergej Konkov, Muenster (DE)

(73) Assignee: HENGST SE, Muenster (DE)

( * ) Notice: Subject to any disclaimer, the term of this patent is extended or adjusted under 35 U.S.C. 154(b) by 0 days.

(21) Appl. No.: 15/774,119

(22) PCT Filed: Nov. 10, 2016

(86) PCT No.: PCT/EP2016/077213
§ 371 (c)(1),
(2) Date: May 7, 2018

(87) PCT Pub. No.: WO2017/081124
PCT Pub. Date: May 18, 2017

(65) Prior Publication Data

US 2018/0318847 A1 Nov. 8, 2018

(30) Foreign Application Priority Data

Nov. 13, 2015 (DE) ..... 10 2015 119 616

(51) Int. Cl.
*B04B 1/08* (2006.01)
*B04B 5/12* (2006.01)
(Continued)

(52) U.S. Cl.
CPC ..... *B04B 7/14* (2013.01); *B04B 1/08* (2013.01); *B04B 5/12* (2013.01); *B04B 2005/125* (2013.01); *B04B 2009/085* (2013.01)

(58) Field of Classification Search
CPC .... B04B 7/14; B04B 1/08; B04B 5/12; B04B 2009/085; B04B 2005/125; B04B 7/12
See application file for complete search history.

(56) References Cited

U.S. PATENT DOCUMENTS 920,481 A * 5/1909 Kimball ..... B04B 1/08 494/64
1,928,080 A * 9/1933 Uebelacker ..... B04B 1/00 494/44
(Continued)

FOREIGN PATENT DOCUMENTS

DE 202008014734 3/2010
GB 157336 A * 4/1922 ..... B04B 7/14
WO 2009010248 1/2009

OTHER PUBLICATIONS

International Search Report, dated Mar. 2, 2017, priority document.

*Primary Examiner* — Charles Cooley
(74) *Attorney, Agent, or Firm* — Greer, Burns & Crain, Ltd.

(57) ABSTRACT

A rotor of a centrifugal separator, wherein the rotor comprises a central shaft on which an axially movable plate stack, formed by multiple plates, is arranged. A stack base is arranged on the shaft under the plate stack. A stack cap is arranged in an axially moveable manner on the shaft above the plate stack. The rotor includes a compression spring surrounding the shaft, with a first end supported on the shaft and a second end supported on the stack cap, pressing the plate stack together. The rotor includes a sleeve-like extension arranged on the stack cap, projecting into the plate stack and surrounding the shaft with a separation. The compression spring is located inside the extension, at least over a majority of the axial length thereof. A support surface for the second end of the compression spring, is arranged on a base of the extension.

21 Claims, 8 Drawing Sheets

(51) Int. Cl.
*B04B 9/08* (2006.01)
*B04B 7/14* (2006.01)

(56) References Cited

U.S. PATENT DOCUMENTS 3,410,481 A * 11/1968 Dahlberg ..... B04B 1/08
494/3
7,674,376 B1 * 3/2010 Herman ..... B04B 1/04
210/297
7,731,772 B2 * 6/2010 Lagerstedt ..... B01D 45/14
210/512.1
9,074,558 B2 * 7/2015 Roelver ..... B01D 45/14
2006/0100083 A1 * 5/2006 Lagerstedt ..... B04B 1/08
494/70
2010/0180854 A1 * 7/2010 Baumann ..... B04B 5/005
123/196 A
2011/0281712 A1 * 11/2011 Schlamann ..... B01D 45/14
494/7
2012/0174541 A1 * 7/2012 Tornblom ..... B04B 5/005
55/409
2012/0174546 A1 * 7/2012 Tornblom ..... B01D 45/14
55/461
2018/0318847 A1 * 11/2018 Luersmann ..... B04B 1/08

* cited by examiner

ROTOR OF A CENTRIFUGAL SEPARATOR WITH AXIALLY ASSEMBLED ELEMENTS CLAMPED BY A SPRING

CROSS-REFERENCES TO RELATED APPLICATIONS

This application claims the benefit of the German patent application No. 10 2015 119 616.6 filed on Nov. 13, 2015, the entire disclosures of which are incorporated herein by way of reference.

BACKGROUND OF THE INVENTION

The present invention relates to a rotor of a centrifugal separator, the rotor having a central shaft on which a plate stack made up of a plurality of plates is situated in axially movable fashion, a stack base being situated on the shaft under the plate stack, a stack cap being situated in axially movable fashion on the shaft over the plate stack, and the rotor having a compression spring surrounding the shaft whose first end is supported on the shaft and whose second end is supported on the stack cap, compressing the plate stack.

A rotor of the type named above is known from WO 2009/010248 A2. In this known rotor, the second end of the compression spring presses on the top side of the stack cap. So that the compression spring can be situated on the shaft, the shaft has to extend past the stack cap by at least the tensioned length of the compression spring. Disadvantageously, this part of the shaft is then not available to accommodate plates of the plate stack.

SUMMARY OF THE INVENTION

An object therefore arises for the present invention of providing a rotor of the type described above that, having the same outer constructive size, has a larger number of plates in the plate stack without having to modify the plates for this purpose.

According to the present invention, this object is achieved by a rotor of the type described above that is characterized in that a sleeve-shaped extension that surrounds the shaft at a distance and extends into the plate stack is situated on the stack cap, and that the compression spring is situated inside the extension at least over the greater part of its axial length, and that a support surface for the second end, at the side of the stack cap, of the compression spring is situated on a base of the extension.

With the present invention, it is advantageously achieved that no additional axial constructive space is required for the situation of the compression spring, because according to the present invention the compression spring lies within the plate stack over the greater part of its axial length, or even over its entire axial length. As a result, the constructive space previously required for the segment of the shaft extending past the stack cap and bearing the compression spring can now also be used to situate plates of the plate stack. In this way, the number of plates in the plate stack can be significantly increased without enlarging the constructive space and without modifying the individual plates, bringing about a corresponding increase in the separating performance of the rotor, or of the centrifugal separator equipped with the rotor.

For reasons of good durability and economical mass production, the stack cap and the sleeve-shaped extension are preferably made in one piece with each other. Alternatively, the stack cap and the sleeve-shaped extension can also be made of two individual parts connected to one another.

In a further embodiment of the rotor according to the present invention, it is preferably provided that the shaft is made of metal and is surrounded by a rotationally fixed cladding made of plastic, the cladding having on its outer circumference an engagement contour for a rotationally fixed, axially movable engagement with a counter-engagement contour on the inner circumference of the plate of the plate stack. The metallic shaft supplies the required stability for the rotor. The contours required for the interaction of the various parts of the rotor can advantageously simply be made on the cladding, because the cladding is made of easily shaped plastic, e.g., thermoplastic or thermosetting plastic.

It is further proposed that the cladding be made on its outer circumference with a toothing made up of teeth running in the axial direction of the shaft, and that the plates of the plate stack are made having a mating counter-toothing on their inner circumference. These contours are easy to produce and reliably provide the desired rotationally fixed but axially movable engagement between the cladding and the plate stack.

A development of the rotor provides that the cladding has, on its end region facing the stack cap, an engagement contour for a rotationally fixed, axially movable engagement with a counter-engagement contour on the sleeve-shaped extension of the stack cap. In this way, a situation of the stack cap of the rotor is achieved that is rotationally fixed relative to the cladding but is axially movable.

In a further embodiment, it is preferably provided that the cladding is fashioned, in its end region facing the stack cap, with a toothing made up of teeth running in the axial direction of the shaft, and that the sleeve-shaped extension of the stack cap is made with a mating counter-toothing.

In order to make it possible to situate the plates in rotationally fixed and axially movable fashion inside the rotor in its region situated close to the stack cap as well, it is preferably provided that the sleeve-shaped continuation of the stack cap has on its outer circumference an engagement contour for a rotationally fixed, axially movable engagement with a counter-engagement contour on the inner circumference of the plates of the plate stack.

So that identical plates can be used within the rotor for the plate stack, and so that the plates can be easily mounted, the engagement contours provided for the plates on the extension of the stack cap and on the cladding are usefully identical to one another and made continuously connected to one another.

In particular, for the purpose of a simple, low-cost, and reliable production, the present invention further provides that the cladding is injection-molded onto the shaft. In this way, it is reliably ensured that the cladding is seated on the shaft in a rotationally fixed fashion.

Also, for reasons of simple and low-cost production and easy assembly of the rotor, the stack base and the cladding are usefully made in one piece with one another. In this way, in a simple and reliable manner the stack base is also configured so as to be rotationally fixed and axially fixed relative to the shaft.

As mentioned above, the compression spring is supported with its first end on the shaft; this supporting can be immediate or indirect. Preferably, the compression spring is supported with its first end, pointing away from the stack cap, on a radially protruding collar of the shaft or on a ring that is axially fixedly connected to the shaft, such as a snap ring, thus achieving a very compact construction.

A development of the rotor according to the present invention is characterized in that between the first end of the compression spring on the one hand, and the collar or ring on the other hand, there is situated an intermediate body, and that the stack cap has an axially outer collar radially outwardly surrounding the intermediate body, the collar being axially displaceable in sealing fashion relative to the intermediate body. In this way, undesired erroneous flows of the fluid medium (that is to be cleaned and is flowing through the rotor) out of the rotor through the sleeve-shaped extension and the stack cap are prevented.

In a further embodiment of the rotor according to the present invention, it is provided that the shaft, seen in its axial direction, is made up of two shaft parts, a first shaft part, which provides a rotatable mounting of the rotor, being made of metal, and a second shaft part, bearing the plate stack, being made of plastic and being connected in rotationally fixed and axially fixed fashion to the first shaft part, and the second shaft part having on its outer circumference an engagement contour for a rotationally fixed, axially movable engagement with a counter-engagement contour on the inner circumference of the plate of the plate stack. Advantageously, in this way the metallic part of the shaft, and thus the weight of the shaft, is reduced, and a greater degree of shaping freedom is enabled with respect to the shaping of the second shaft part.

In order to make it possible to securely situate the plates of the plate stack on the second shaft part, with a simple shaping, it is proposed that the second shaft part is made with a toothing on its outer circumference made up of teeth running in the axial direction of the second shaft part, and that the plates of the plate stack are made on their inner circumference with a mating counter-toothing.

In a further embodiment, it is provided that the second shaft part has, on its end region facing the stack cap, an engagement contour for a rotationally fixed, axially movable engagement with a counter-engagement contour on the sleeve-shaped extension of the stack cap. In this way, via the sleeve-shaped extension of the stack cap, the plate stack can be pressed together in a desired manner, thus avoiding an undesirable rotation of the stack cap with the extension relative to the second shaft part.

A further embodiment in this regard provides that the second shaft part is made, in its end region facing the stack cap, with a toothing made up of teeth running in the axial direction of the shaft, and that the sleeve-shaped extension of the stack cap is made with a mating counter-toothing. In this way, reliable functioning is achieved with a simple shaping of the engagement contour and counter-engagement contour.

So that the sleeve-shaped extension of the stack cap can also be used for the situation of plates of the plate stack, it is proposed that the sleeve-shaped extension of the stack cap has on its outer circumference an engagement contour for a rotationally fixed, axially movable engagement with a counter-engagement contour on the inner circumference of the plates of the plate stack.

Preferably, here the engagement contours on the extension and on the second shaft part for the plates are made identical to one another and continuously connected to one another. In this way, inside the rotor identical plates can be used for the plate stack regardless of whether a plate is situated on the extension or on the second shaft part.

In order to ensure a good and permanent connection between the two shaft parts, the second shaft part is usefully injection-molded onto the first shaft part.

Also for reasons of a permanent secure connection, as well as low-cost production, the stack base and the second shaft part are preferably made in one piece with one another.

Due to the fact that the second shaft part is made of plastic, as mentioned above, this part can be made more freely with regard to its shape. An advantageous embodiment in this regard provides that the compression spring is supported with its first end, pointing away from the stack cap, on radially protruding supporting lugs of spring bearing arms that form a part of the second shaft part and that run axially and are radially springy. A separate ring to be connected in axially fixed fashion to the shaft, such as a snap ring, is here not required for the supporting of the first end, pointing away from the stack cap, of the compression spring. During the assembly of the rotor, it is sufficient to slide the compression spring over the radially protruding support lugs of the axially running, radially springy spring bearing arms, pushing in the spring bearing arms in the direction toward the base of the extension of the stack cap, until the spring bearing arms spring out again, and the compression spring is then supported with its first end pointing away from the stack cap on the radially protruding support lugs of the springy spring support arms.

Finally, for the rotor according to the present invention, it is provided that the plates, the stack base, and the stack cap are injection-molded parts made of plastic. In this way, the named parts of the rotor can be easily produced at low cost as mass-produced parts, simultaneously achieving an advantageously low weight of the rotor.

BRIEF DESCRIPTION OF THE DRAWINGS

In the following, an exemplary embodiment of the present invention is explained on the basis of a drawing.

In the following description of the Figures, identical parts in the various figures are always provided with the same reference characters, so that all reference characters do not have to be explained again for each Figure.

DETAILED DESCRIPTION OF THE PREFERRED EMBODIMENTS

Figure 1:
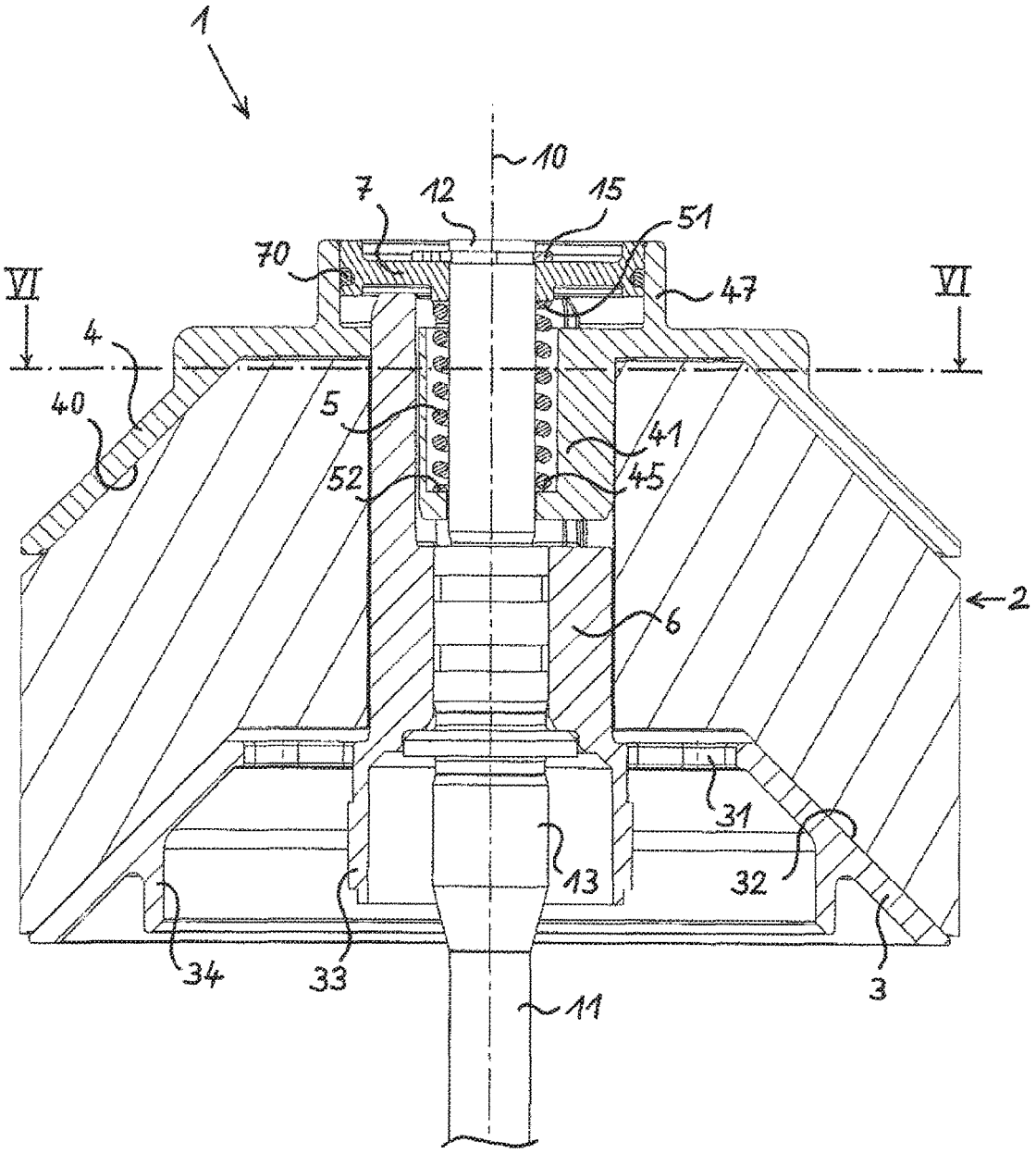
FIG. 1 shows a rotor in the assembled state, in a first embodiment, partly in longitudinal section, partly in a front view.

FIG. 1 shows a rotor 1 of a centrifugal separator in the assembled state, in longitudinal section. Rotor 1 has a central shaft 11 that is made of metal, such as steel, and that in the operational state of a centrifugal separator is rotatably mounted therein and is capable of being set into rotation about an axis of rotation 10 by a rotational drive (not shown).

In the axially center region in FIG. 1 of shaft 11, a cladding 6 made of plastic and surrounding shaft 11 radially externally is attached on this shaft in rotationally fixed and axially fixed fashion, for example, injection-molded on. A stack base 3 is made in one piece with cladding 6, the base having an upward-pointing support surface 32.

A plate stack 2 that is made up of a multiplicity of plates, not shown individually here, is set onto base 6 from above, and lies with its lower side on support surface 32 of stack base 3.

At its upper side, plate stack 2 is covered by a stack cap 4 that lies on the upper side of plate stack 2 with a lower-side support surface 40. Stack cap 4 has, radially inwardly, a sleeve-shaped extension 41 that extends into plate stack 2 and that surrounds shaft 11 at a distance. A base of extension 41 has an opening through which shaft 11 is guided.

In the interior of extension 41 there is situated a compression spring 5, in the form of a helical spring. With its first, upper end, compression spring 5 is supported on an intermediate body 7 that, for its part, is axially supported by a ring 15 close to the upper, free end 12 of shaft 11. Second, lower end 52 of compression spring 5 is supported on a support surface 45 that is formed by the upper side of the base of extension 41.

Through the force of compression spring 5, stack cap 4 is axially loaded in the direction toward stack base 3, so that stack base 3 and stack cap 4 clamp plate stack 2 between them, and stabilize it in its shape. The adjacent plates of plate stack 2 form, in a known manner, flat gap spaces between them, through which, during operation of rotor 1, there flows the gas that is to be freed of particles that it carries along. In a likewise known manner, the plates of plate stack 2 each have the form of a frustum-shaped cladding having an inclined radially outer part and a flat radially inner part, as is explained in more detail below on the basis of FIGS. 4 and 5.

Due to the fact that here compression spring 5 is situated over its entire length inside sleeve-shaped extension 41, almost the entire axial height of shaft 11 above stack base 3 can be used to situate plate stack 2. Advantageously, an upper part of shaft 11 does not extend relatively far past stack cap 4 for the situation of compression spring 5. In this way, with the same axial constructive height of rotor 1, a plate stack 2 having a significantly larger number of plates can be accommodated.

On the lower side of stack base 3, concentrically to one another, there are integrally formed an inner sleeve-shaped extension 33 and a radially external sleeve-shaped extension 34. In a radially inner region of stack base 3, distributed over its circumference, inlet openings 31 are situated between extensions 33, 34, through which openings a gas that is to be freed of liquid or solid particles, for example crank case ventilation gas of an internal combustion engine, can enter into plate stack 2 during operation of rotor 1. The gas is then diverted outwardly in the radial direction into the gap spaces of plate stack 2, and exits plate stack 2 at its outer circumference. The particles carried along in the gas meet the inner surfaces of plate stack 2, and in this way are separated from the gas flow, and, as a result of the rotation of rotor 1, are deposited on the inner circumference of a separator housing (not shown here) that surrounds rotor 1 in a known manner during operation.

In order to prevent erroneous flows of the gas from plate stack 2 out of rotor 1 through the interior of sleeve-shaped extension 41, intermediate body 7 is sealed by a sealing ring 70 in a hollow cylindrical collar 47 integrally formed at the upper side on stack cap 4; here stack cap 4 can move, to a limited, adequate degree, in the axial direction of rotor 1 relative to intermediate body 7 supported on shaft 11, in order to accommodate tolerances or changes in the height of plate stack 2 occurring as a result of temperature.

In a region immediately below stack base 3, shaft 11 has a bearing surface 13 that is used for the situation of a plain bearing or roller bearing not shown separately here. In a part of shaft 11 situated further below, not shown here, there is situated a rotational drive having a suitable known design.

Figure 2:
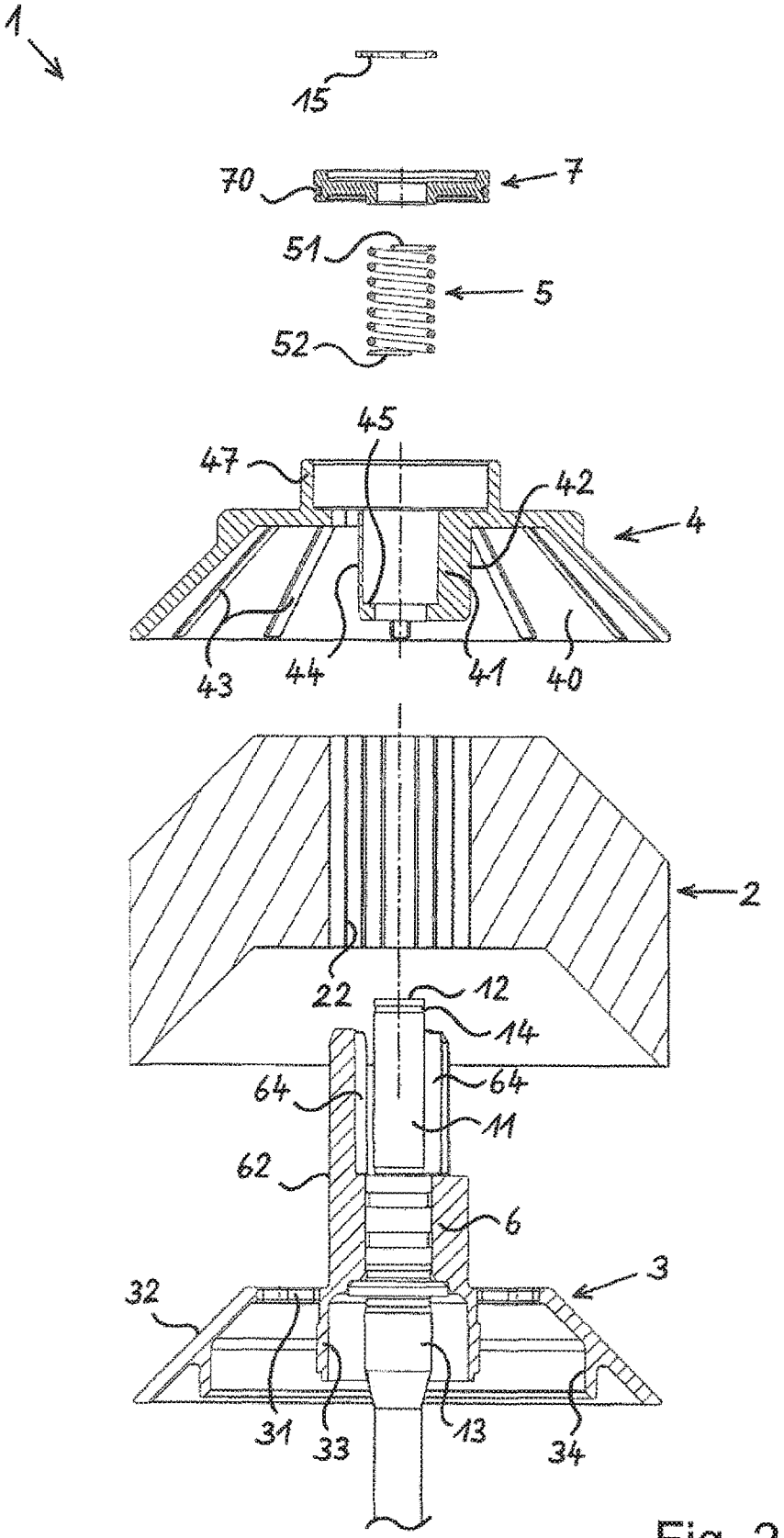
FIG. 2 shows the rotor of FIG. 1 in a disassembled individual part representation, partly in longitudinal section, partly in a front view.

FIG. 2 shows rotor 1 of FIG. 1 in a disassembled individual part representation, in longitudinal section.

At bottom in FIG. 2, central shaft 11 is visible, onto which cladding 6 is injection-molded in one piece with stack base 3. Bearing surface 13 of shaft 11 is situated at the height of stack base 3. Upper end 12 of shaft 11, having a groove 14 for ring 15, is situated above the upper end of cladding 6. Cladding 6 has on its outer circumference an engagement contour 62 that can be brought into a rotationally fixed but axially movable engagement with a counter-engagement contour 22 on the inner circumference of the individual plates of plate stack 2.

Above plate stack 2, stack cap 4 is shown, having, centrally in its interior, sleeve-shaped extension 41 extending in the direction toward plate stack 2. On its outer circumference, extension 41 has on the one hand an engagement contour 42 that is identical to engagement contour 62 on cladding 6 and that interacts with counter-engagement contour 22 of the plates of plate stack 2 when rotor 1 is assembled. On the other hand, extension 41 has on its outer circumference a counter-engagement contour 44 that, in the assembled state, interacts with an engagement contour 64 in the upper region of cladding 6, such that contours 44, 64 bring stack cap 4 into engagement with stack base 3 in rotationally fixed but axially movable fashion.

On its downward-pointing side, stack cap 4 has a support surface 40 for the upper side of plate stack 2. Here, spacer webs 43, running in the radial direction, are integrally formed on support surface 40, so that a gap that is effective for the separation is also formed between the upper side of plate stack 2 and the lower side of stack cap 4.

Hollow cylindrical collar 47 for accommodating intermediate body 7 is integrally formed at the upper side on stack cap 4.

Above stack cap 4, compression spring 5, in the form of the helical spring, is visible with its first, upper end 51 and its second, lower end 52. In the assembled state, upper end 51 of compression spring 5 is supported on the lower side of intermediate body 7, here shown above compression spring 5. In the assembled state, the second, lower end 52 of compression spring 5 is supported on support surface 45, which is formed by the upper side of a base of sleeve-shaped extension 41 of stack cap 4.

Intermediate body 7 essentially has the shape of a flat circular annular disc having a central opening, through which, in the assembled state, upper end 12 of central shaft 11 extends. Circumferential sealing ring 70, for example an O-ring, is situated radially outwardly on intermediate body 7.

Finally, all the way at the top in FIG. 2 ring 15 is shown, which in the assembled state is set into groove 14 close to upper end 12 of shaft 11.

Figure 3:
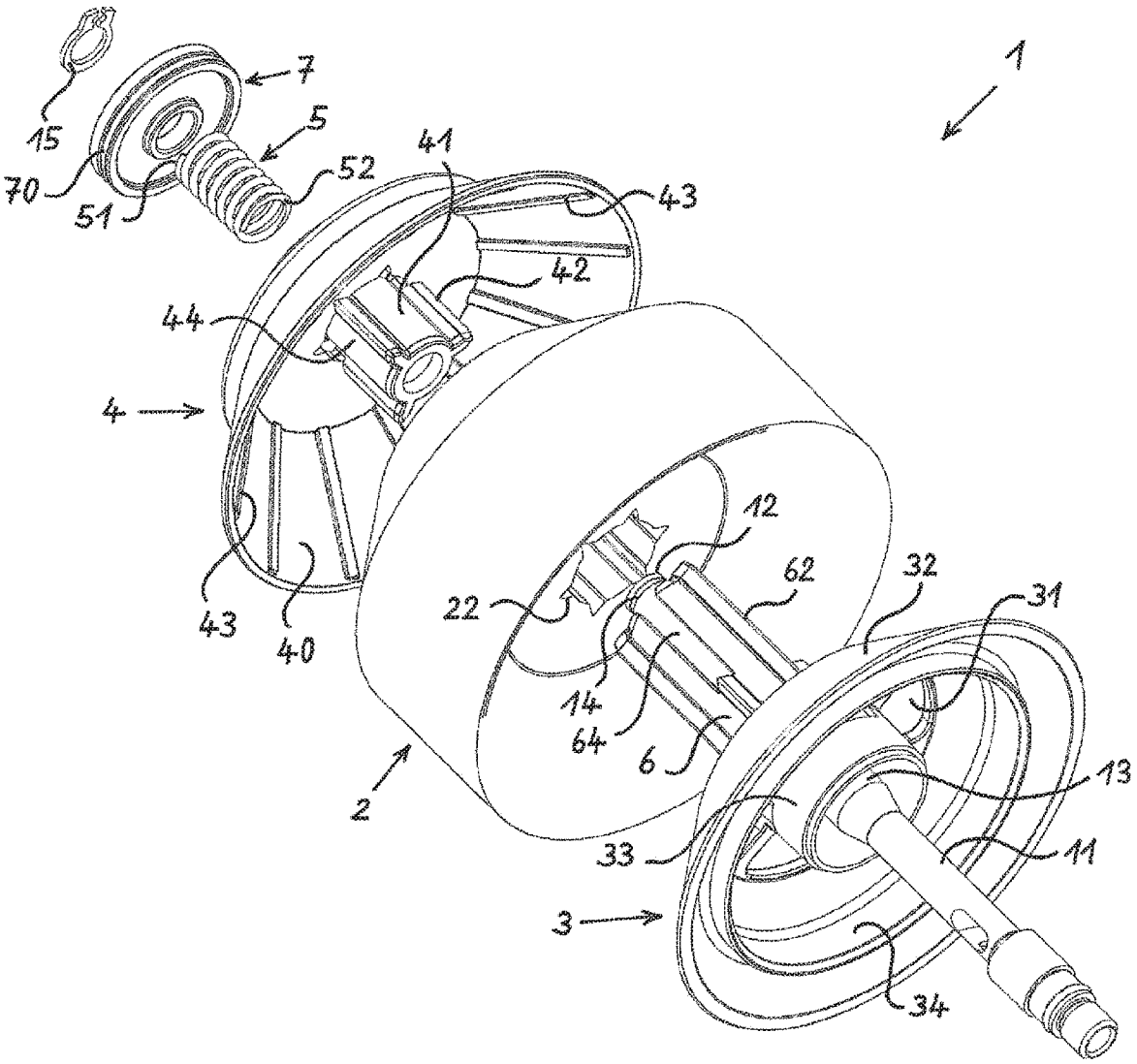
FIG. 3 shows the rotor of FIG. 1 in a disassembled individual part representation, in an oblique view from below.

FIG. 3 shows rotor 1 of FIG. 1 in a disassembled individual part representation, in an oblique view from below. At bottom in FIG. 3, central shaft 11 is visible with cladding 6 injection-molded thereon and with stack base 3 made in one piece therewith. On the lower side of stack base 3, radially inner sleeve-shaped extension and radially outer sleeve-shaped extension 34 are visible, which together form a flow guide for a gas to be cleaned that enters into plate stack 2 through inlet openings 31 in stack base 3.

Above stack base 3, cladding 6 is visible with its engagement contours 62, 64 for plate stack 2 and for stack cap 4. Upper end 12 of shaft 11, with groove 14 for ring 15, extends from cladding 6 at the top.

Above upper end 12 of shaft 11, plate stack 2 is shown as a further component, and here as well, for reasons of clarity, the individual plates of plate stack 2, which in practice are very thin, are not shown. On the inner circumference of plate stack 2, its counter-engagement contour 22 can be seen, which in the assembled state interacts with engagement contour 62 of cladding 6 and engagement contour 42 of extension 41 of stack cap 4 to hold plate stack 2 so as to be axially movable and rotationally fixed.

Above plate stack 2, stack cap 4 is shown, in whose interior sleeve-shaped extension 41 is situated. On the outer circumference of extension 41, engagement contour 42 for plate stack 2 and counter-engagement contour 44 for interaction with engagement contour 64 on cladding 6 are visible. Above support surface 40 of stack cap 4, which points downward in the direction toward plate stack 2, radial spacer webs 43 run with regular distances from one another, seen in the circumferential direction.

Above stack cap 4, compression spring 5 is visible with its first, upper end 51 and its second, lower end 52. Above this there follows intermediate body 7 with its outer circumferential sealing ring 70. Finally, all the way at the top in FIG. 3, ring 15, here realized as a snap ring, is visible, which can be set into groove 14 on the upper end 12 of central shaft 11, and which holds together the parts of rotor 1 in the assembled state.

Figure 4:
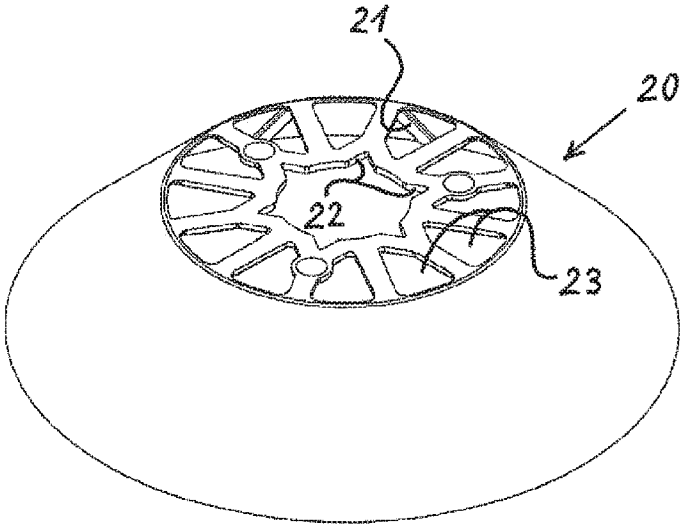
FIG. 4 shows a plate of a plate stack of the rotor of FIG. 1, in an oblique view from above.

FIG. 4 shows a plate 20 of plate stack 2 of the rotor of FIGS. 1 through 3, in an oblique view from above. Here it can be seen particularly clearly that each plate 20 has the shape of a frustum-shaped cladding. The radially outer part of plate 20, which runs at an incline, is realized as a closed surface. The radially inner, flat region of plate 20 is provided with counter-engagement contour 22 on its inner circumference. Radially outward therefrom, flow perforations 23 are distributed around the circumference, through which the gas that is to be cleaned during operation flows in axially, and from where the gas is then diverted outward in the radial direction, into the gap spaces between the adjacent plates 20.

Figure 5:
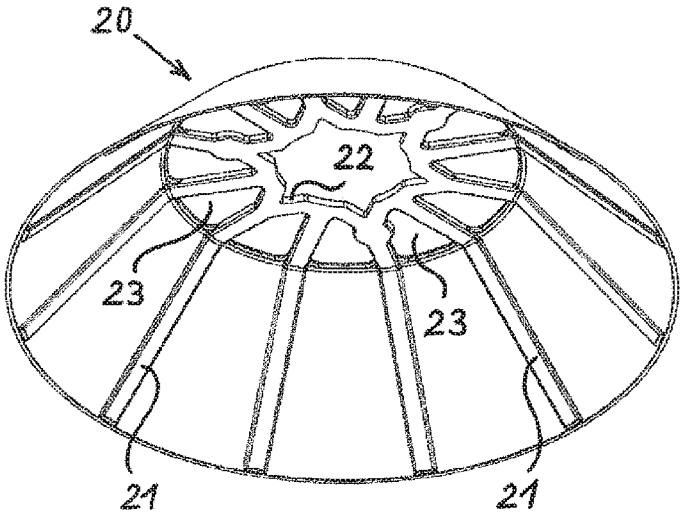
FIG. 5 shows the plate of FIG. 4 in an oblique view from below.

FIG. 5 shows plate 20 of FIG. 4 in an oblique view from below. Here, the configuration of spacer webs 21, running over the lower side of the obliquely oriented region of each plate 20, is particularly clear. In the center of plate 20, counter-engagement contour 22 can also be seen in FIG. 5. Radially outward therefrom, flow perforations 23 are distributed around the circumference.

As FIGS. 1 through 5 illustrate, stack base 3, stack cap 4, and the individual plates 20 of plate stack 2 are advantageously produced as injection-molded parts made of plastic. Intermediate body 7 can also be an injection-molded part made of plastic. Only shaft 11, compression spring 5, and ring 15 are parts made of metal, standardly steel.

Figure 6:
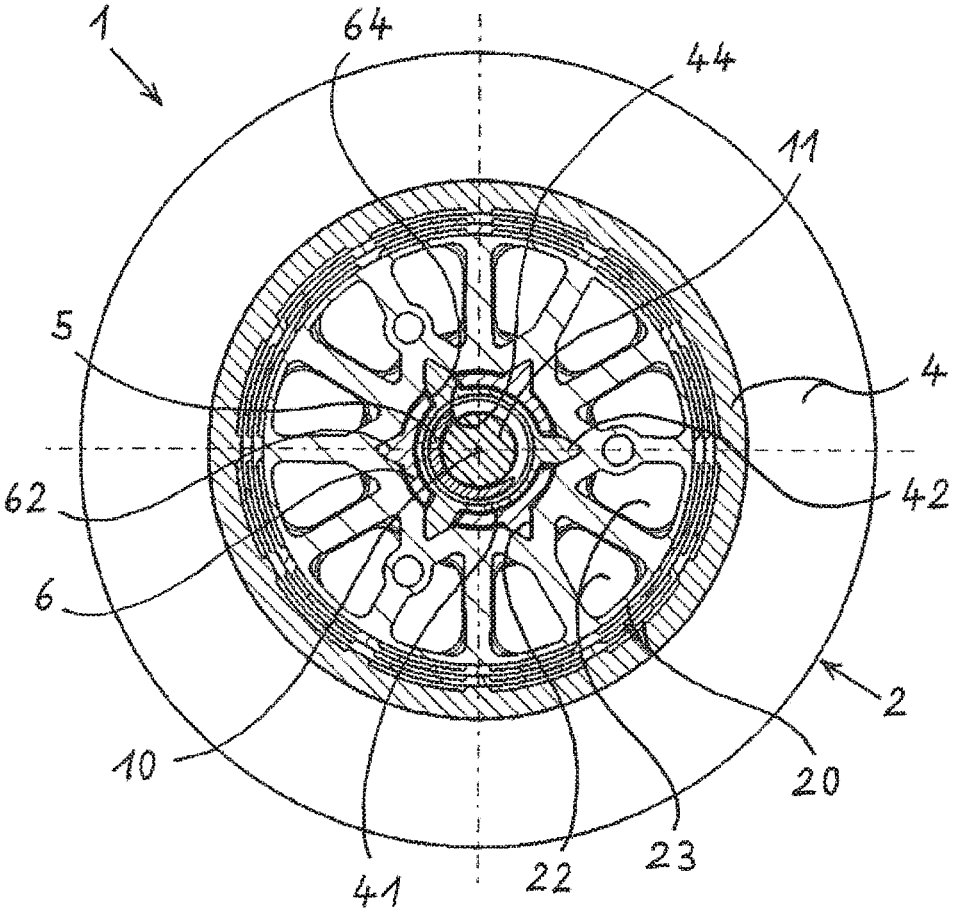
FIG. 6 shows the rotor of FIG. 1 in cross-section along the sectional line VI-VI in FIG. 1.

FIG. 6 shows rotor 1 of FIG. 1 in cross-section along sectional line VI-VI in FIG. 1. In the center of FIG. 6, perpendicular to the plane of the drawing there runs central shaft 11, whose mid-axis simultaneously forms axis of rotation 10 of rotor 1. Compression spring 5, realized as a helical spring, is situated surrounding shaft 11, and this spring is in turn surrounded by sleeve-shaped extension 41 of stack cap 4. Cladding 6, which surrounds an upper part of central shaft 11, runs around extension 41. Still further outward radially, finally, there follows plate stack 2, which is made up of a multiplicity of plates 20. In their radially inner region, plates 20 each have a plurality of flow perforations 23 distributed in the circumferential direction.

Extension 41 has, on its outer circumference, engagement contour 42, formed by a toothing running in the longitudinal direction of extension 41, which toothing engages with counter-engagement contour 22 on the inner circumference of upper plates 20 of plate stack 2.

In addition, cladding 6 also has on its outer circumference an engagement contour 62 that is identical to and coincides with engagement contour 42 of extension 41, and which engages with counter-engagement contour 22 on the inner circumference of plates 20, situated further below, of plate stack 2.

So that no relative rotation can take place between extension 41 and cladding 6, cladding 6 has an engagement contour 64 that stands in engagement with an engagement contour 44 of extension 41.

All above-named engagement contours 42, 62, 64 and counter-engagement contours 22, 44 are fashioned such that the associated parts of rotor 1 are secured against rotation relative to one another, but are axially movable.

Figure 7:
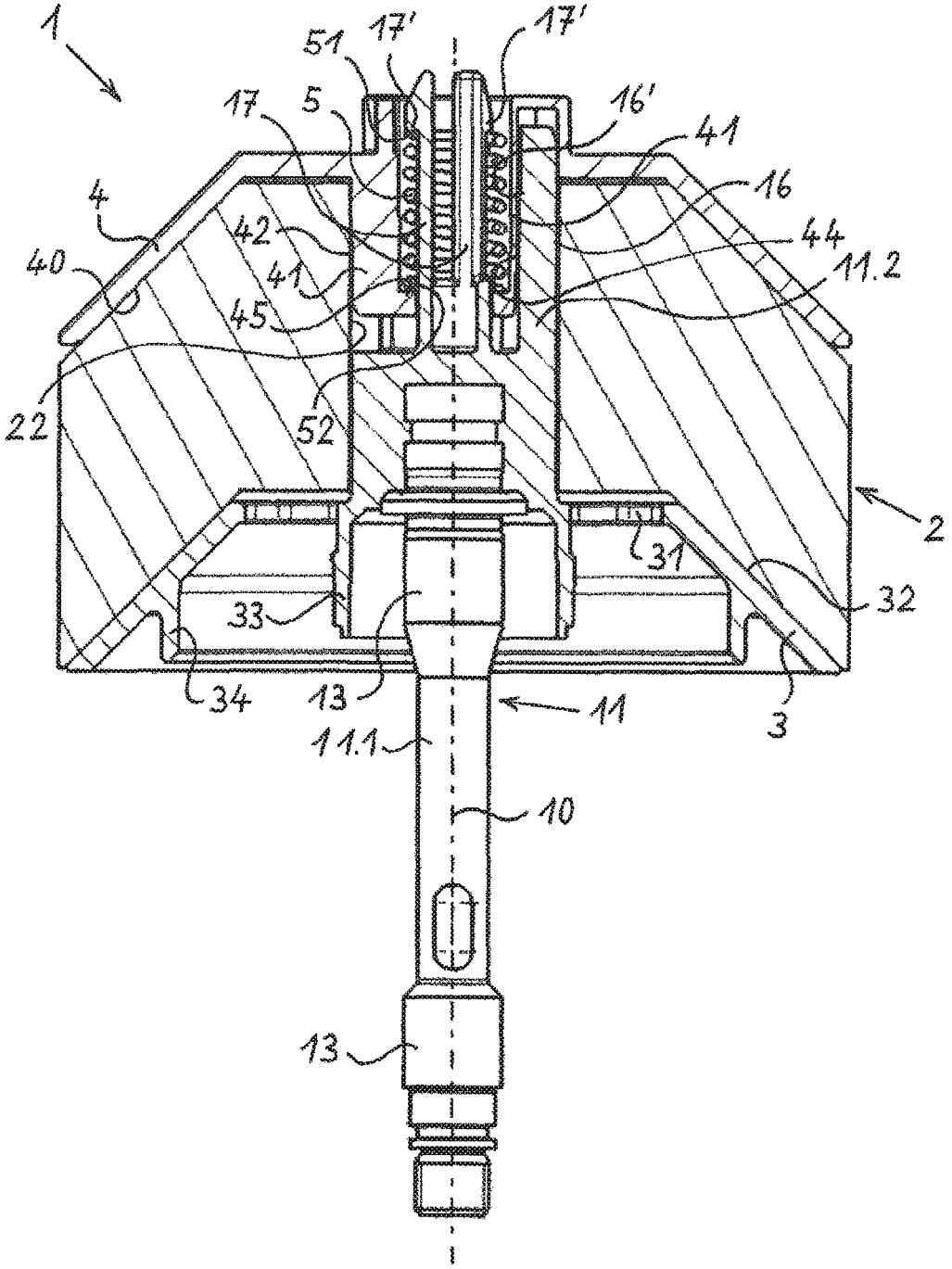
FIG. 7 shows the rotor in the assembled state, in a second embodiment, partly in longitudinal section, partly in a front view.

FIG. 7 shows rotor 1 in the assembled state, in a second embodiment, partly in longitudinal section, partly in a front elevational view. In the center of rotor 1 there runs central shaft 11, whose mid-axis forms axis of rotation 10 of rotor 1.

Differing in particular from the previously described exemplary embodiment here is the fact that central shaft 11 has a first, lower, metallic shaft part 11.1 and a second, upper, shaft part 11.2 made of plastic. Second shaft part 11.2 made of plastic is preferably injection-molded onto first, metallic shaft part 11.1. Metallic first shaft part 11.1 has two bearing surfaces 13 axially at a distance from one another, on which rotor 1 can be rotatably mounted inside a centrifugal separator by plain bearings or roller bearings.

Here as well, stack cap 4 has a sleeve-shaped extension 41, integrally formed in one piece, which extends into plate stack 2 and in which compression spring 5, for compressing plate stack 2, is situated between stack base 3 and stack cap 4. Here as well, compression spring 5 is supported with its lower end 52 on a support surface 45 formed by a base of extension 41. Here, differing from the first exemplary embodiment, upper end 51 of compression spring 5 is axially supported on a plurality of support lugs 17' which are integrally formed on the free upper end of a plurality of spring bearer arms 17, configured in a circle, which are made in one piece with second shaft part 11.2 and are part of second shaft part 11.2. Compression spring 5 here surrounds the configuration of spring bearer arms 17, and support lugs 17' point radially outward.

Thus, when installing rotor 1, it is sufficient to push compression spring 5 onto the configuration of spring bearer arms 17 from the top, after placing stack base 3, plate stack 2, and stack cap 4 onto shaft 11, spring bearer arms 17 being pushed flexibly inward in the radial direction until compression spring 5 has reached the position shown in FIG. 7, in which upper spring end 51 is situated below support lugs 17', so that spring bearer arms 17 can then spring back outward in the radial direction and support compression spring 5 with their support lugs 17'. Thus, the attachment of a securing ring or snap ring, as a separate component, on shaft 11 in order to form an upper support for compression spring 5 is not required here.

In order to make it possible to situate plates 20 of plate stack 2 on shaft 11 and on extension 41 in rotationally fixed fashion but so as to be axially movable, shaft 11 has engagement contour 16 in its second shaft part 11.2 on the outer circumference, and extension 41 has engagement contour 42 on its outer circumference, which contours engage with counter-engagement contour 22 on plates 20. Moreover, engagement contour 16' on second shaft part 11.2 and counter-engagement contour 44 on sleeve-shaped extension 41 stand in engagement with one another.

With regard to the further individual parts of rotor 1 shown in FIG. 7, reference is made to the preceding description, in particular of FIG. 1.

Figure 8:
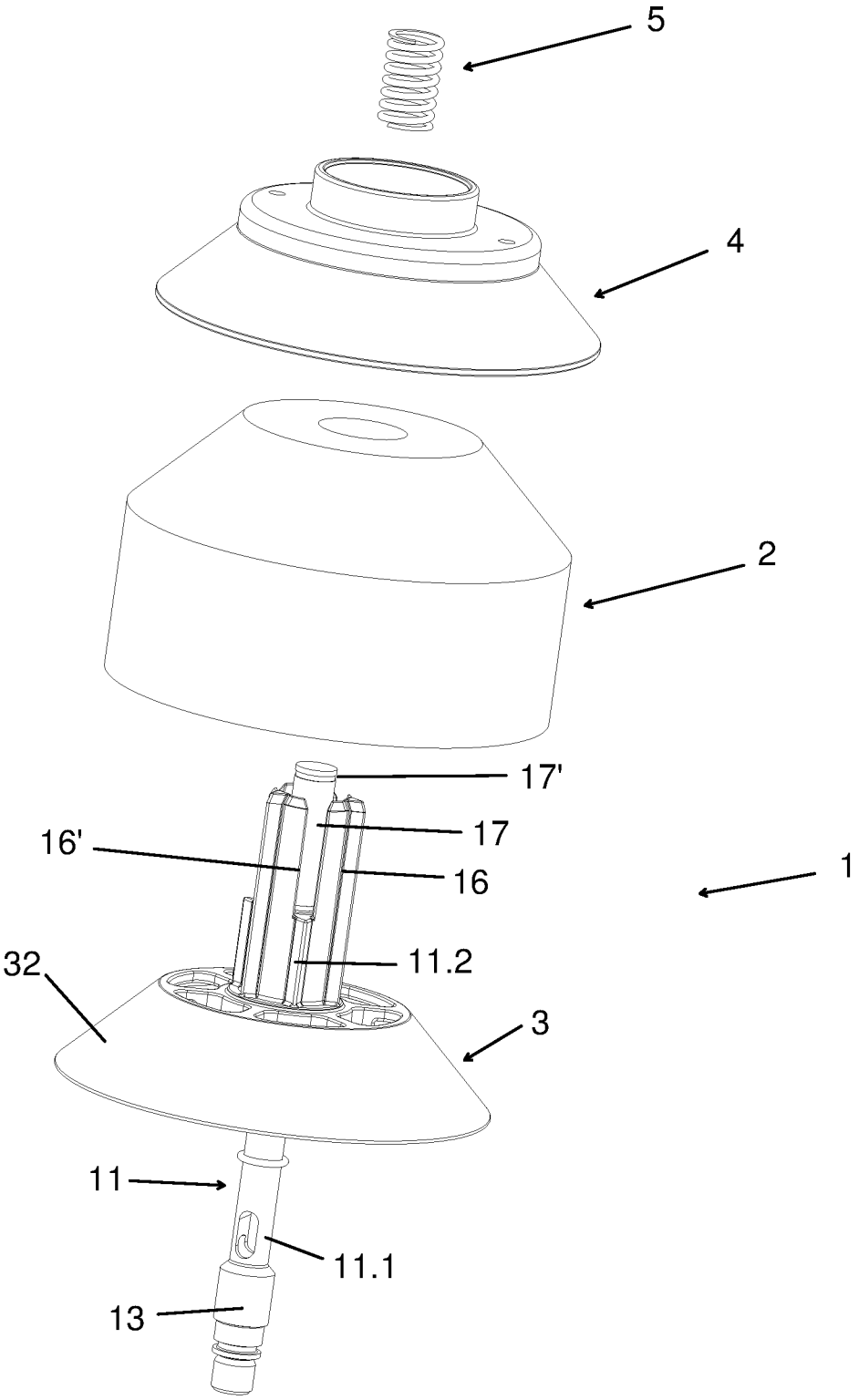
FIG. 8 shows the rotor of FIG. 7 in a disassembled individual part representation, in a slightly oblique view from above.

FIG. 8 shows the rotor of FIG. 7 in a disassembled individual part representation, in a slightly oblique view from above. At bottom in FIG. 8, central shaft 11 is visible with its lower, first shaft part 11.1 made of metal, such as steel, and its upper, second shaft part 11.2 made of plastic. Stack base 3 is here made in one piece with upper, second shaft part 11.2, and is injection-molded as a unit onto first, metallic shaft part 11.1. At its upper side, stack base 3 has a conical support surface 32, matched to the shape of plates 20 of plate stack 2. In a radially inner, upper region of stack base 3, there are situated inlet openings 31 for supplying a fluid to be cleaned, such as crankcase ventilation gas of an internal combustion engine, into the interior of plate stack 2.

On second shaft part 11.2, engagement contours 16, 16', spring bearer arms 17, and their support lugs 17' are visible.

Above this, FIG. 8 schematically shows plate stack 2, and above this in turn stack cap 4. Finally, all the way at the top in FIG. 8 compression spring 5 is visible.

Figure 9:
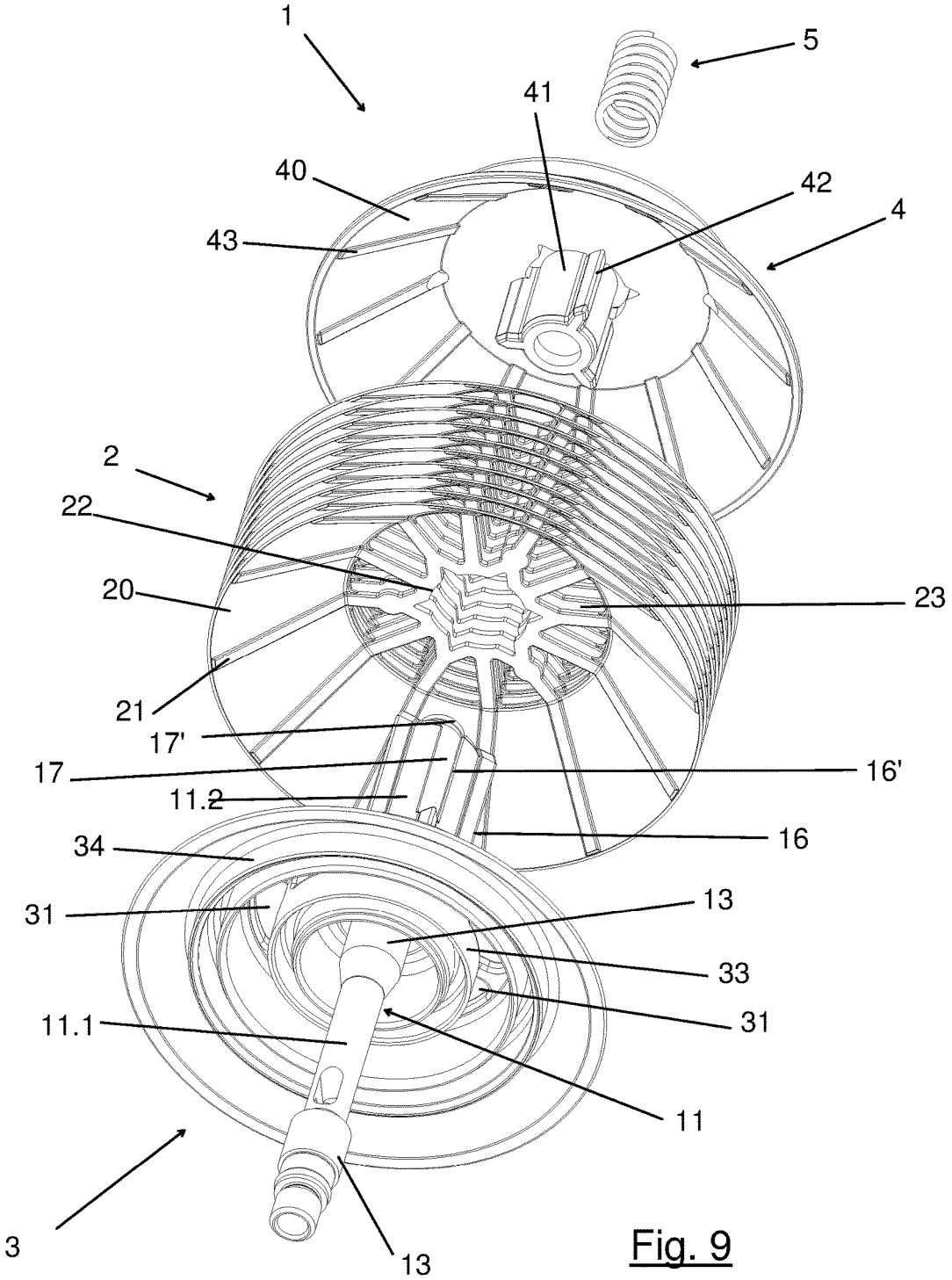
FIG. 9 shows the rotor of FIG. 7 in a disassembled individual part representation, in an oblique view from below.

For the installation of rotor 1, plate stack 2 is pushed in the axial direction onto the upper, second shaft part 11.2, producing the rotationally fixed but axially movable engagement. Subsequently, stack cap 4 is also placed onto second shaft part 11.2, producing the rotationally fixed but axially movable engagement. As the last step, compression spring 5 is placed from above onto spring bearer arms 17, which form a part of second shaft part 11.2, with their support lugs 17', and is locked under tension, whereby stack cap 4 is loaded with a force in the direction towards stack base 3, and in this way plate stack 2 is axially compressed in the desired manner Finally, FIG. 9 shows rotor 1 of FIG. 7 in a disassembled individual part representation, in an oblique view from below. At bottom in FIG. 9, central shaft 11 is again visible with its metallic first shaft part 11.1 and its second shaft part 11.2, made in one piece with stack base 3 made of plastic.

Second shaft part 11.2 has engagement contours 16, 16', spring bearer arms 17, and support lugs 17'.

As in the previously described first exemplary embodiment, here as well stack base 3 has on its lower side a radially inner sleeve-shaped extension 33 and a radially outer sleeve-shaped extension 34. Moreover, here inlet openings 31 of stack base 3 are visible from below.

Further up in FIG. 9, plate stack 2 is visible, made up of a multiplicity of plates 20 each having the shape of a frustum. On the lower side of their conical, radially outer part, plates 20 have spacer webs 21 that are used to hold open a desired intermediate space between each two adjacent plates 20 in plate stack 2. In the center of plates 20, their counter-engagement contour 22 is situated, surrounded by flow perforations 23.

Still further up in FIG. 9, stack cap 4 is visible, whose shape is matched to the upper side of plate stack 2 and which has on its lower side a support surface 40 for plate stack 2, as well as spacer webs 43. In the center of the underside of stack cap 4, its sleeve-shaped extension 41 is partly visible, having on its outer circumference engagement contour 42, which in the assembled state of rotor 1 interacts with counter-engagement contour 22 of upper plate 20 in plate stack 2.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

LIST OF REFERENCE CHARACTERS

1 rotor
10 axis of rotation
11 central shaft
11.1, 11.2 first, second shaft part
12 free (upper) end of 11
13 bearing surface
14 groove on 11 for 15
15 ring on 11
16, 16' engagement contours for 2, 4 on 11.2
17 spring bearer arms
17' support lugs on 17
2 plate stack
20 plates
21 spacer webs on 20
22 counter-engagement contour on 20 for 62, 16
23 flow perforations
3 stack base
31 inlet openings on 3
32 support surface for 2
33 radially inner sleeve-shaped extension on 3
34 radially outer sleeve-shaped extension on 3
4 stack cap
40 support surface for 2
41 sleeve-shaped extension on 4
42 engagement contour on 4 for 22
43 spacer webs on 4
44 counter-engagement contour on 4 for 64, 16'
45 support surface for 5 in 41
47 collar on 4 for 7
5 compression spring
51 first, upper end of 5
52 second, lower end of 5
6 cladding on 11
62 engagement contour for 2
64 engagement contour for 4
7 intermediate body
70 sealing ring

What is claimed is:

1. A rotor of a centrifugal separator, the rotor comprising:

a central shaft on which a plate stack made up of a plurality of plates is situated in an axially movable fashion, a stack base being situated on the shaft under the plate stack, a stack cap being situated in an axially movable fashion on a portion of the central shaft above the plate stack, and a compression spring surrounding the central shaft, a first end of the compression spring being supported on the central shaft and a second end of the compression spring being supported on the stack cap so as to compress the plate stack, wherein, on the stack cap there is situated a sleeve-shaped extension that extends into the plate stack and surrounds the shaft at a distance, wherein the compression spring is situated within the sleeve-shaped extension at least over a greater part of its axial length, and wherein a support surface for the second end, at a side of the stack cap, of the compression spring is situated on a base of the sleeve-shaped extension.

2. The rotor as recited in claim 1, wherein the shaft is made of metal and is surrounded by a rotationally fixed cladding made of plastic, the cladding having on its outer circumference an engagement contour for a rotationally fixed, axially movable engagement with a counter-engagement contour on an inner circumference of the plates of the plate stack.

3. The rotor as recited in claim 2, wherein the cladding is fashioned on its outer circumference with a toothing made up of teeth running in an axial direction of the central shaft, and that the plates of the plate stack are fashioned on their inner circumference with a mating counter-toothing.

4. The rotor as recited in claim 2, wherein the cladding has, on its end region facing the stack cap, an engagement contour for a rotationally fixed, axially movable engagement with a counter-engagement contour on the sleeve-shaped extension of the stack cap.

5. The rotor as recited in claim 4, wherein the cladding is fashioned, in its end region facing the stack cap, with a toothing made up of teeth running in an axial direction of the central shaft, and that the sleeve-shaped extension of the stack cap is fashioned with a mating counter-toothing.

6. The rotor as recited in claim 2, wherein the sleeve-shaped extension of the stack cap has on its outer circumference an engagement contour for a rotationally fixed, axially movable engagement with a counter-engagement contour on the inner circumference of the plates of the plate stack.

7. The rotor as recited in claim 6, wherein the engagement contour on the extension and the engagement contour on the cladding for the plates are fashioned identically to one another and continuously connected to one another.

8. The rotor as recited in claim 2, wherein the cladding is injection-molded onto the shaft.

9. The rotor as recited in claim 2, wherein the stack base and the cladding are made in one piece with one another.

10. The rotor as recited in claim 1, wherein the compression spring is supported with its first end, pointing away from the stack cap, on a radially protruding collar of the shaft or on a ring that is connected to the shaft in axially fixed fashion.

11. The rotor as recited in claim 10, wherein an intermediate body is situated between the first end of the compression spring and the collar or ring, and wherein the stack cap has an axially outer collar that radially outwardly surrounds the intermediate body and that is axially movable in sealing fashion relative to the intermediate body.

12. The rotor as recited in claim 1, wherein the central shaft, seen in its axial direction, is made up of two shaft parts, a first shaft part, which provides a rotational bearing of the rotor, being made of metal, a second shaft part, bearing the plate stack, being made of plastic and being connected to the first shaft part in rotationally fixed and axially fixed fashion, and the second shaft part having on its outer circumference an engagement contour for a rotationally fixed, axially movable engagement with a counter-engagement contour on an inner circumference of the plates of the plate stack.

13. The rotor as recited in claim 12, wherein the second shaft part is fashioned on its outer circumference with a toothing made up of teeth running in the axial direction of the second shaft part, and that the plates of the plate stack are fashioned on their inner circumference with a mating counter-toothing.

14. The rotor as recited in claim 12, wherein the second shaft part has, on its end region facing the stack cap, an engagement contour for a rotationally fixed, axially movable engagement with a counter-engagement contour on the sleeve-shaped extension of the stack cap.

15. The rotor as recited in claim 14, wherein the second shaft part is fashioned in its end region facing the stack cap with a toothing made up of teeth running in the axial direction of the shaft, and that the sleeve-shaped extension of the stack cap is fashioned with a mating counter-toothing.

16. The rotor as recited in claim 12, wherein the sleeve-shaped extension of the stack cap has on its outer circumference an engagement contour for a rotationally fixed, axially movable engagement with a counter-engagement contour on the inner circumference of the plates of the plate stack.

17. The rotor as recited in claim 16, wherein the engagement contour on the extension and the engagement contour on the second shaft part for the plates are made identically to one another and continuously connected to one another.

18. The rotor as recited in claim 12, wherein the second shaft part is injection-molded onto the first shaft part.

19. The rotor as recited in claim 12, wherein the stack base and the second shaft part are made in one piece with one another.

20. The rotor as recited in claim 12, wherein the compression spring is supported with its first end, pointing away from the stack cap, on radially protruding support lugs of spring bearer arms that form a part of the second shaft part and run axially and are radially flexible.

21. The rotor as recited in claim 1, wherein the plates, the stack base, and the stack cap are injection-molded parts made of plastic.

* * * * *